US006034044A

United States Patent [19]

Scheper et al.

[11] Patent Number: 6,034,044

[45] Date of Patent: Mar. 7, 2000

[54] LOW FOAMING AUTOMATIC DISHWASHING COMPOSITIONS

[75] Inventors: William Michael Scheper, Lawrenceburg, Ind.; Laura Lee Turner, Cincinnati, Ohio; Kuntal Chatterjee, St. Louis, Mo.; Lynda Anne Speed, Gosforth; Graeme Duncan Cruickshank, Killingworth, both of United Kingdom

[73] Assignee: The Procter & Gamble Company, Cincinnati, Ohio

[21] Appl. No.: 09/301,822

[22] Filed: Apr. 29, 1999

Related U.S. Application Data

[63] Continuation-in-part of application No. 08/905,505, Aug. 2, 1997, Pat. No. 5,483,664

[60] Provisional application No. 60/024,726, Sep. 11, 1996, and provisional application No. 60/031,265, Nov. 15, 1996.

[51] Int. Cl.[7] ..... C11D 1/66; C11D 3/395; C11D 3/075; C11D 10/02

[52] U.S. Cl. ..... 510/220; 510/226; 510/376; 510/379; 510/535

[58] Field of Search ..... 510/220, 226, 510/224, 228, 376, 379, 535

[56] References Cited

U.S. PATENT DOCUMENTS

| | | | |
|---|---|---|---|
| 4,048,121 | 9/1977 | Chang | 252/527 |
| 4,233,171 | 11/1980 | McLaughlin et al. | 252/99 |
| 4,272,394 | 6/1981 | Kaneko | 252/99 |
| 4,810,410 | 3/1989 | Diakun et al. | 252/102 |
| 5,094,771 | 3/1992 | Ahmed et al. | 252/99 |
| 5,518,648 | 5/1996 | Welch et al. | 252/174.22 |
| 5,576,281 | 11/1996 | Bunch et al. | 510/220 |
| 5,589,099 | 12/1996 | Baum | 510/514 |
| 5,612,305 | 3/1997 | Lewis | 510/220 |
| 5,616,277 | 4/1997 | Raleigh et al. | 510/220 |
| 5,616,546 | 4/1997 | Miracle et al. | 510/223 |
| 5,703,034 | 12/1997 | Offshack et al. | 510/376 |
| 5,807,810 | 9/1998 | Blezard et al. | 507/103 |
| 5,877,134 | 3/1999 | Scheper et al. | 510/220 |
| 5,912,218 | 6/1999 | Chatterjee et al. | 510/220 |

FOREIGN PATENT DOCUMENTS

| | | | |
|---|---|---|---|
| WO 93/04153 | 3/1993 | WIPO | C11D 3/08 |
| WO 94/22800 | 10/1994 | WIPO | C07C 43/11 |

*Primary Examiner*—Yogendra Gupta
*Assistant Examiner*—John M Petruncio
*Attorney, Agent, or Firm*—Ian S. Robinson; Kim William Zerby; Jacobus C. Rasser

[57] ABSTRACT

Automatic dishwashing detergent compositions comprising a mixed nonionic surfactant system comprising low cloud point and high cloud point nonionic surfactants.

20 Claims, No Drawings

LOW FOAMING AUTOMATIC DISHWASHING COMPOSITIONS

CROSS REFERENCE

This application is a continuation-in-part of U.S. application Ser. No. 8/905,505, filed Aug. 2, 1997, now U.S. Pat. No. 5,488,664; which claims priority under Title 35 United States Code 120 to U.S. patent application No. 08/764,826, filed Dec. 12, 1996, now U.S. Pat. No. 5,877,134, issued Mar. 2, 1999 and U.S. patent application Ser. No. 08/766,394, filed Dec. 12, 1996; both of which claim priority under Title 35 United States Code 119(e) to U.S. Provisional Application Serial Nos. 601024,726, filed Sep. 11, 1996 and 60/031,265, filed Nov. 15, 1996.

TECHNICAL FIELD

The present invention is in the field of automatic dishwashing detergents comprising surfactants and preferably bleach. More specifically, the invention encompasses automatic dishwashing detergents (liquids, pastes, and solids such as tablets and especially granules) comprising builder (e.g., phosphate and/or citrate/carbonate), bleaching agent (e.g., hypochlorite; perborate; percarbonate) and a mixed nonionic surfactant system comprising low cloud point and high cloud point nonionic surfactants. Preferred compositions contain perborate and/or percarbonate bleaching systems, further preferably comprising bleach activators and/or metal-containing bleach catalysts (e.g., manganese and/or selected cobalt/ammonia catalysts), and detersive enzymes (e.g., amylase; protease). Preferred methods for washing tableware are included.

BACKGROUND OF THE INVENTION

Automatic dishwashing, particularly in domestic appliances, is an art very different from fabric laundering. Domestic fabric laundering is normally done in purpose-built machines having a tumbling action. These are very different from spray-action domestic automatic dishwashing appliances. The spray action in the latter tends to cause foam. Foam can easily overflow the low sills of domestic dishwashers and slow down the spray action, which in turn reduces the cleaning action. Thus in the distinct field of domestic machine dishwashing, the use of common foam-producing laundry detergent surfactants is normally restricted. These aspects are but a brief illustration of the unique formulation constraints in the domestic dishwashing field.

Automatic dishwashing with bleaching chemicals is different from fabric bleaching. In automatic dishwashing, use of bleaching chemicals involves promotion of soil removal from dishes, though soil bleaching may also occur. Additionally, soil antiredeposition and anti-spotting effects from bleaching chemicals are desirable. Some bleaching chemicals (such as a hydrogen peroxide source, alone or together with tetraacetylethylenediamine, aka "TAED") can, in certain circumstances, be helpful for cleaning dishware On account of the foregoing technical constraints as well as consumer needs and demands, automatic dishwashing detergent (ADD) compositions are undergoing continual change and improvement. Moreover enviromnental factors such as the restriction of phosphate, the desirability of providing ever-better cleaning results with less product, providing less thermal energy, and less water to assist the washing process, have all driven the need for improved ADD compositions.

In spite of such continuing changes to the formulation of ADD compositions, there continues to be a need for better cleaning ADD compositions, especially for removal of greasy soils. Typically, in other types of cleaning compositions such as laundry detergent compositions, cleaning improvements are continually being made by changing and improving the surfactants used. However, as noted hereinbefore, ADD compositions have the unique limitation of requiring very low sudsing compositions which is incompatible with most of the surfactant systems and ingredients typically used in other cleaning compositions.

The exception is that low cloud point, low foaming nonionic surfactants have been used. But the cleaning performance therefrom has generally been very limited due to the requirement that low foaming nonionic surfactants are generally low cloud point nonionic surfactants, which have limited solubility in the wash solution. The lack of solubility of such nonionic surfactants greatly limits their cleaning ability, providing instead mainly spotting reduction benefits. Attempts at utilizing the more soluble, higher cloud point nonionic surfactants have typically failed due to unacceptable foaming of such surfactants. Thus, there continues to be a need for ADD compositions containing surfactants which provide cleaning benefits (e.g., greasy soil removal benefits) without unacceptably high sudsing.

The present invention ADD composition comprising mixed high cloud point/low cloud point nonionic surfactant systems satisfy this long felt need. It is therefore an object of the present invention to provide ADD compositions comprising surfactant systems which provide cleaning benefits, especially greasy soil cleaning benefits (e.g., lipstick), while at the same time producing an acceptably low level of sudsing. These and other benefits of the present invention will be apparent from the detailed description which follows.

BACKGROUND ART

U.S. Pat. No. 4,272,394, issued Jun. 9, 1981 to Kaneko, WO 94/22800, published Oct. 13, 1994 by Olin Corporation, WO 93/04153, published Mar. 4, 1993 by the Procter & Gamble Co.

SUMMARY OF THE INVENTION

It has now been discovered that automatic dishwashing detergent ("ADD") compositions comprising builder and a mixed nonionic surfactant system, preferably further comprising a bleaching agent and/or enzymes, provide superior cleaning, especially greasy soil removal benefits.

The present invention therefore encompasses automatic dishwashing detergent compositions comprising:

(a) from about 5% to about 90% (preferably from about 5% to about 75%, more preferably from about 10% to about 50%) by weight of the composition of a builder (preferably phosphate or nil-phosphate builder systems containing citrate and carbonate);

(b) from about 0.1% to about 15% (preferably from about 0.2% to about 10%, more preferably from about 0.5% to about 5%) by weight of the composition of a mixed nonionic surfactant system, wherein said mixed nonionc surfactant system comprises one or more low cloud point nonionic surfactants having a cloud point of less than 30° C. and one or more high cloud point nonionic surfactants having a cloud point of greater than 40° C., the ratio of low cloud point to high cloud point nonionic surfactants being within the range of from about 10:1 to about 1:10 (preferably from about 5:1 to about 1:5, more preferably from about 1:2 to about 2:1);

(c) optionally, from about 0.1% to about 40% by weight of the composition of a bleaching agent (preferably a hypochlorite, e.g., sodium dichloroisocyanurate, "NaDCC", or source of hydrogen peroxide bleaching system, e.g. perborate or percarbonate), preferably also containing a cobalt bleach catalyst and/or a manganese bleach catalyst; and (d) adjunct materials, preferably automatic dishwashing detergent adjunct materials selected from the group consisting of enzymes, chelating agents, and mixtures thereof.

The preferred compositions herein comprise a bleaching system which is a source of hydrogen peroxide, preferably perborate and/or percarbonate, and preferably also comprise a cobalt-containing bleach catalyst or a manganese-containing bleach catalyst. Preferred cobalt-containing bleach catalysts have the formula:

$$[Co(NH_3)_n(M)_m(B)_b]T_y$$

wherein cobalt is in the +3 oxidation state; n is 4 or 5 (preferably 5); M is ne or more ligands coordinated to the cobalt by one site; m is 0, 1 or 2 (preferably 1); B is a ligand coordinated to the cobalt by two sites; b is 0 or 1 (preferably 0), and hen b=0, then m+n=6, and when b=1, then m=0 and n=4; and T is one or more counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C.). Also, in another mode, the compositions of the present invention are those wherein the bleach catalyst is a member selected from the group consisting of manganese bleach catalysts, especially manganese "TACN", as described more fully hereinafter.

Additional bleach-improving materials can be present such as bleach activator materials, including tetraacetylethylenediamine ("TAED") and cationic bleach activators, e.g., 6-trimethylammoniocaproyl caprolactam, tosylate salt.

The preferred detergent compositions herein further comprise a protease and/or amylase enzyme. Whereas conventional amylases such as TERMAMYL® may be used with excellent results. Preferred ADD compositions can use oxidative stability-enhanced amylases. Such an amylase is available from Novo Nordisk (described more fully in WO 94/02597, published Feb. 3, 1994) and from Genencor International (described more fully in WO 94/18314, published Aug. 18, 1994) Oxidative stability is enhanced by substitution of the methionine residue located in position 197 of *B. Licheniformis* or the homologous position variation of a similar parent amylase. Typical proteases include Esperase, Savinase, and other proteases as described hereinafter.

The present invention encompasses (but is not limited to) granular-form, fully-formulated ADD's in which additional ingredients, including other enzymes (especially proteases and/or amylases) are formulated, along with other ADD product forms such as liquidgels and tablets.

The instant invention also encompasses cleaning methods; more particularly, a method of washing tableware in a domestic automatic dishwashing appliance, comprising treating the soiled tableware in an automatic dishwasher with an aqueous alkaline bath comprising an ADD composition as provided hereinbefore.

As already noted, the invention has advantages, including the excellent greasy soil removal, good dishcare, and good overall cleaning.

All parts, percentages and ratios used herein are expressed as percent weight unless otherwise specified. All documents cited are, in relevant part, incorporated herein by reference.

DETAILED DESCRIPTION OF THE INVENTION

Automatic Dishwashing Compositions

Automatic dishwashing compositions of the present invention comprise builder and a mixed nonionic surfactant system, and preferably also include a bleaching agent (such as a chlorine bleach or a source of hydrogen peroxide) and/or detersive enzymes. Bleaching agents useful herein include chlorine oxygen bleaches (e.g., hypochlorite or NADCC) and sources of hydrogen peroxide, including any common hydrogen-peroxide releasing salt, such as sodium perborate, sodium percarbonate, and mixtures thereof. Also useful are sources of available oxygen such as persulfate bleach (e.g., OXONE, manufactured by DuPont). In the preferred embodiments, additional ingredients such as water-soluble silicates (useful to provide alkalinity and assist in controlling corrosion), dispersant polymers (which modify and inhibit crystal growth of calcium and/or magnesium salts), chelants (which control transition metals), alkalis (to adjust pH), and detersive enzymes (to assist with tough food cleaning, especially of starchy and proteinaceous soils), are present. Additional bleach-modifying materials such as conventional bleach activators (e.g. TAED and/or bleach catalysts) may be added, provided that any such bleach-modifying materials are delivered in such a manner as to be compatible with the purposes of the present invention. The present detergent compositions may, moreover, comprise one or more processing aids, fillers, perfumes, conventional enzyme particle-making materials including enzyme cores or "nonpareils", as well as pigments, and the like.

In general, materials used for the production of ADD compositions herein are preferably checked for compatibility with spotting/filming on glassware. Test methods for spotting/filming are generally described in the automatic dishwashing detergent literature, including DIN and ASTM test methods. Certain oily materials, especially at longer chain lengths, and insoluble materials such as clays, as well as long-chain fatty acids or soaps which form soap scum are therefore preferably limited or excluded from the instant compositions.

Amounts of the essential ingredients can vary within wide ranges, however preferred automatic dishwashing detergent compositions herein (which typically have a 1% aqueous solution pH of above about 8, more preferably from about 9.5 to about 12, most preferably from about 9.5 to about 10.5) are those wherein there is present: from about 5% to about 90%, preferably from about 5% to about 75%, of builder; from about 0.1% to about 40%, preferably from about 0.5% to about 30%, of bleaching agent; from about 0.1% to about 15%, preferably from about 0.2% to about 10%, of the mixed nonionic surfactant system; from about 0.0001% to about 1%, preferably from about 0.001% to about 0.05%, of a metal-containing bleach catalyst (most preferred cobalt catalysts useful herein are present at from about 0.001% to about 0.01%); and from about 0.1% to about 40%, preferably from about 0.1% to about 20% of a water-soluble (two ratio) silicate. Such fully-formulated embodiments typically further comprise from about 0.1% to about 15% of a polymeric dispersant, from about 0.01% to about 10% of a chelant, and from about 0.00001% to about 10% of a detersive enzyme, though further additional or adjunct ingredients may be present. Detergent compositions herein in granular form typically limit water content, for example to less than about 7% free water, for best storage stability.

While the present invention compositions may be formulated using chlorine-containing bleach additive, preferred ADD compositions of this invention (especially those comprising detersive enzymes) are substantially free of chlorine bleach. By "substantially free" of chlorine bleach is meant that the formulator does not deliberately add a chlorine-containing bleach additive, such as a dichloroisocyanurate, to the preferred ADD composition. However, it is recognized that because of factors outside the control of the formulator, such as chlorination of the water supply, some non-zero amount of chlorine bleach may be present in the wash liquor. The term "substantially free" can be similarly constructed with reference to preferred limitation of other ingredients.

By "effective amount" herein is meant an amount which is sufficient, under whatever comparative test conditions are employed, to enhance cleaning of a soiled surface. Likewise, the term "catalytically effective amount" refers to an amount of metal-containing bleach catalyst which is sufficient under whatever comparative test conditions are employed, to enhance cleaning of the soiled surface. In automatic dishwashing, the soiled surface may be, for example, a porcelain cup with tea stain, a porcelain cup with lipstick stain, dishes soiled with simple starches or more complex food soils, or a plastic spatula stained with tomato soup. The test conditions will vary, depending on the type of washing appliance used and the habits of the user. Some machines have considerably longer wash cycles than others. Some users elect to use warm water without a great deal of heating inside the appliance; others use warm or even cold water fill, followed by a warm-up through a built-in electrical coil. Of course, the performance of bleaches and enzymes will be affected by such considerations, and the levels used in fully-formulated detergent and cleaning compositions can be appropriately adjusted.

Nonionic Surfactant System

Nonionic surfactants useful in the present invention Automatic Dishwashing compositions are desirably included in the present detergent compositions at levels of from about 0.1% to about 15% of the composition. In general, bleach-stable surfactants are preferred. Nonionic surfactants generally are well known, being described in more detail in Kirk Othmer's Encyclopedia of Chemical Technology, 3rd Ed., Vol. 22, pp. 360–379, "Surfactants and Detersive Systems", incorporated by reference herein.

While a wide range of nonionic surfactants may be selected from for purposes of the mixed nonionic surfactant systems useful in the present invention ADD compositions, it is necessary that the nonionic surfactants comprise both a low cloud point and high cloud point nonionic surfactant(s) as described as follows. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360–362, hereinbefore).

As used herein, a "low cloud point" nonionic surfactant is defined as a nonionic surfactant system ingredient having a cloud point of less than 30° C., preferably less than about 20° C., and most preferably less than about 10° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., Olin Corporation's Poly-Tergent® SLF18) and epoxy-capped poly (oxyalkylated) alcohols (e.g., Olin Corporation's Poly-Tergent® SLF18B series of nonionics, as described, for example, in WO 94/22800, published Oct. 13, 1994 by Olin Corporation).

Nonionic surfactants can optionally contain propylene oxide in an amount up to about 15% by weight. Other preferred nonionic surfactants can be prepared by the processes described in U.S. Pat. No. 4,223,163, issued Sep. 16, 1980, Builloty, incorporated herein by reference.

Low cloud point nonionic surfactants additionally comprise a polyoxyethylene, polyoxypropylene block polymeric compound. Block polyoxyethylene-polyoxypropylene polymeric compounds include those based on ethylene glycol, propylene glycol, glycerol, trimethylolpropane and ethylenediamine as initiator reactive hydrogen compound. Certain of the block polymer surfactant compounds designated PLURONIC®, REVERSED PLURONIC®, and TETRONIC® by the BASF-Wyandotte Corp., Wyandotte, Mich., are suitable in ADD compositions of the invention. Preferred examples include REVERSED PLURONIC® 25R2 and TETRONIC® 702, Such surfactants are typically useful herein as low cloud point nonionic surfactants.

As used herein, a "high cloud point" nonionic surfactant is defined as a nonionic surfactant system ingredient having a cloud point of greater than 40° C., preferably greater than about 50° C., and more preferably greater than about 60° C. Preferably the nonionic surfactant system comprises an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis. Such high cloud point nonionic surfactants include, for example, Tergitol 15S9 (supplied by Union Carbide), Rhodasurf TMD 8.5 (supplied by Rhone Poulenc), and Neodol 91-8 (supplied by Shell).

It is also preferred for purposes of the present invention that the high cloud point nonionic surfactant further have a hydrophile-lipophile balance ("HLB"; see Kirk Othmer hereinbefore) value within the range of from about 9 to about 15, preferably 11 to 15. Such materials include, for example, Tergitol 15S9 (supplied by Union Carbide), Rhodasurf TMD 8.5 (supplied by Rhone Poulenc), and Neodol 91-8 (supplied by Shell).

Another preferred high cloud point nonionic surfactant is derived from a straight or preferably branched chain or secondary fatty alcohol containing from about 6 to about 20 carbon atoms ($C_6$–$C_{20}$ alcohol), including secondary alcohols and branched chain primary alcohols. Preferably, high cloud point nonionic surfactants are branched or secondary alcohol ethoxylates, more preferably mixed C9/11 or C11/15 branched alcohol ethoxylates, condensed with an average of from about 6 to about 15 moles, preferably from about 6 to about 12 moles, and most preferably from about 6 to about 9 moles of ethylene oxide per mole of alcohol. Preferably the ethoxylated nonionic surfactant so derived has a narrow ethoxylate distribution relative to the average.

The nonionic surfactant systems useful herein are mixed high cloud point and low cloud point nonionic surfactants combined in a weight ratio preferably within the range of from about 10:1 to about 1:10. Preferred are ADD compositions comprising such mixed nonionic surfactant systems wherein the sudsing (absent any silicone suds controlling agent) is less than 2 inches, preferably less than 1 inch, determined as follows:

In a preferred embodiment the detergent composition also comprises an amount of water-soluble salt to provide conductivity in deionised water at 25° C. greater than 3 milli Siemens/cm, preferably greater than 4 milli Siemens/cm, most preferably greater than 4.5 milli Siemens/cm as described in co-pending PCT Patent Application PCT/US97/15977 published Mar. 19, 1997,(attorney docket number CM 1573).

In another preferred embodiment the mixed surfactant system dissolves in water having a hardness of 1.246 mmol/L in any suitable cold-fill automatic dishwasher to provide a solution with an interfacial tension of less than 4 Dynes/cm$^2$, more preferably less than 2 Dynes/cm$^2$, at less than 45° C., preferably less than 40° C., most preferably less than 35° C. A typical cold-fill dishwasher uses between 4 and 5 Litres, preferably 4.5 Litres of mains water per fill, into which the operator generally dispenses between 15 g to 25 g, preferably 20 g of compact detergent composition. A typical was cycle will take approximately between 60 and 80 minutes depending on the quantity of dishware in the dishwasher. The wash cycle generally consists of 45 sections; (i) a cold pre-wash; (ii) main wash cycle during wash cold water is fed into the dishwasher and heated to a temperature of between 50° C. and 70° C.; (iii) cold rinse; (iv) hot rinse during which the rinse water is heated to a temperature of between 50° C. and 70° C.; (v) drying. Examples of suitable cold-fill dishwashers include Bosch 6032, Miele G579 , Hotpoint 7882 and Zanussi 925.

In another preferred embodiment the high cloud point and low cloud point surfactants of the mixed surfactant system are separated such that one of either the high cloud point or low cloud point surfactants is present in a first matrix and the other is present in a second matrix. The first matrix may for example be a first particulate and the second matrix may be a second particulate. A surfactant may be applied to a particulate by any suitable known method, preferably the surfactant is sprayed onto the particulate.

In a particularly preferred aspect the automatic dishwashing detergent composition described herein is preferably in tablet form, comprising a compressed portion and a non-compressed portion as described in co-pending PCT Patent Application PCT/US98/16144 published Feb. 10, 1999, (attorney docket number CM 1572). In this embodiment the first matrix may be the compressed portion and the second matrix may be the non-compressed portion of the detergent tablet. The compressed and non-compressed portion of the tablet preferably dissolve at different rates. Preferably the high cloud point surfactant is present in the portion with the most rapid dissolution rate.

Measuring Dishwasher Arm RPM Efficiency and Wash Suds Height

The equipment useful for these measurements are: a Whirlpool Dishwasher (model 900) equipped with clear plexiglass door, IBM computer data collection with Labview and Excel Software, proximity sensor (Newark Corp.—model 95F5203) using SCXI interface, and a plastic ruler.

The data is collected as follows. The proximity sensor is affixed to the bottom dishwasher rack on a metal bracket. The sensor faces downward toward the rotating dishwasher arm on the bottom of the machine (distance approximately 2 cm. from the rotating arm). Each pass of the rotating arm is measured by the proximity sensor and recorded. The pulses recorded by the computer are converted to rotations per minute (RPM) of the bottom arm by counting pulses over a 30 second interval. The rate of the arm rotation is directly proportional to the amount of suds in the machine and in the dishwasher pump (i.e., the more suds produced, the slower the arm rotation).

The plastic ruler is clipped to the bottom rack of the dishwasher and extends to the floor of the machine. At the end of the wash cycle, the height of the suds is measured using the plastic ruler (viewed through the clear door) and recorded as suds height.

The following procedure is followed for evaluating ADD compositions for suds production as well as for evaluating nonionic surfactant systems for utility in such systems. (For separate evaluation of nonionic surfactant systems, a base ADD formula, such as Cascade powder, is used along with the nonionic surfactants which are added separately in glass vials to the dishwashing machine.)

First, the machine is filled with water (adjust water for appropriate temperature and hardness) and proceed through a rinse cycle. The RPM is monitored throughout the cycle (approximately 2 min.) without any ADD product (or surfactants) being added (a quality control check to ensure the machine is functioning properly). As the machine begins to fill for the wash cycle, the water is again adjusted for temperature and hardness, and then the ADD product is added to the bottom of the machine (in the case of separately evaluated surfactant systems, the ADD base formula is first added to the bottom of the machine then the surfactants are added by placing the surfactant-containing glass vials inverted on the top rack of the machine). The RPM is then monitored throughout the wash cycle. At the end of the wash cycle, the suds height is recorded using the plastic ruler. The machine is again filled with water (adjust water for appropriate temperature and hardness) and runs through another rinse cycle. The RPM is monitored throughout this cycle.

An average RPM is calculated for the 1st rinse, main wash, and final rinse. The % RPM efficiency is then calculated by dividing the average RPM for the test surfactants into the average RPM for the control system (base ADD formulation without the nonionic surfactant system). The RPM efficiency and suds height measurements are used to dimension the overall suds profile of the surfactant system.

Builders

Detergent builders other than silicates can optionally be included in the compositions herein to assist in controlling mineral hardness. Inorganic as well as organic builders can be used. Builders are used in automatic dishwashing to assist in the removal of particulate soils.

The level of builder can vary widely depending upon the end use of the composition and its desired physical form. The compositions will typically comprise at least about 1% builder. High performance compositions typically comprise from about 5% to about 90%, more typically from about 5% to about 75% by weight, of the detergent builder. Lower or higher levels of builder, however, are not excluded.

Inorganic or non-phosphate-containing detergent builders include, but are not limited to, phosphonates, phytic acid, silicates, carbonates (including bicarbonates and sesquicarbonates), sulfates, citrate, zeolite or layered silicate, and aluminosilicates.

Examples of carbonate builders are the alkaline earth and alkali metal carbonates as disclosed in German Patent Application No. 2,321,001 published on Nov. 15, 1973. Various grades and types of sodium carbonate and sodium sesquicarbonate may be used, certain of which are particularly useful as carriers for other ingredients, especially detersive surfactants.

Aluminosilicate builders may be used in the present compositions though are not preferred for automatic dishwashing detergents. (See U.S. Pat. No. 4,605,509 for examples of preferred aluminosilicates.) Aluminosilicate builders are of great importance in most currently marketed heavy duty granular detergent compositions, and can also be a significant builder ingredient in liquid detergent formulations. Aluminosilicate builders include those having the empirical formula: $Na_2O.Al_2O_3.xSiO_z.yH_2O$ wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In another embodiment, the crystalline aluminosilicate ion exchange material has the formula: $Na_{12}[(AlO_2\mathbf{0}_{12}(SiO_2)_{12}].xH_2O$ wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter. Individual particles can desirably be even smaller than 0.1 micron to further assist kinetics of exchange through maximization of surface area. High surface area also increases utility of aluminosilicates as adsorbents for surfactants, especially in granular compositions. Aggregates of silicate or aluminosilicate particles may be useful, a single aggregate having dimensions tailored to minimize segregation in granular compositions, while the aggregate particle remains dispersible to submicron individual particles during the wash. As with other builders such as carbonates, it may be desirable to use zeolites in any physical or morphological form adapted to promote surfactant carrier function, and appropriate particle sizes may be freely selected by the formulator.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediaminetetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty laundry detergent and automatic dishwashing formulations due to their availability from renewable resources and their biodegradability. Citrates can also be used in combination with zeolite, the aforementioned BRITESIL types, and/or layered silicate builders. Oxydisuccinates are also useful in such compositions and combinations.

Also suitable in the detergent compositions of the present invention are the 3,3-dicarboxy-4-oxa-1,6-hexanedionates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also U.S. Pat. No. 3,723,322.

Fatty acids, e.g., $Cl_2$–$Cl_8$ monocarboxylic acids, may also be incorporated into the compositions alone, or in combination with the aforesaid builders, especially citrate and/or the succinate builders, to provide additional builder activity but are generally not desired. Such use of fatty acids will generally result in a diminution of sudsing in laundry compositions, which may need to be taken into account by the formulator. Fatty acids or their salts are undesirable in Automatic Dishwashing (ADD) embodiments in situations wherein soap scums can form and be deposited on dishware.

Where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used though such materials are more commonly used in a low-level mode as chelants or stabilizers.

Phosphate detergent builders for use in ADD compositions are well known. They include, but are not limited to, the alkali metal, ammonium and alkanolammonium salts of polyphosphates (exemplified by the tripolyphosphates, pyrophosphates, and glassy polymeric meta-phosphates). Phosphate builder sources are described in detail in Kirk Othmer, 3rd Edition, Vol. 17, pp. 426–472 and in "Advanced Inorganic Chemistry" by Cotton and Wilkinson, pp. 394–400 (John Wiley and Sons, Inc.; 1972).

Preferred levels of phosphate builders herein are from about 10% to about 75%, preferably from about 15% to about 50%, of phosphate builder.

Bleaching Agents

Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms. An "effective amount" of a source of hydrogen peroxide is any amount capable of measurably improving stain removal (especially of tea stains) from soiled dishware compared to a hydrogen peroxide source-free composition when the soiled dishware is washed by the consumer in a domestic automatic dishwasher in the presence of alkali.

More generally a source of hydrogen peroxide herein is any convenient compound or mixture which under consumer use conditions provides an effective amount of hydrogen peroxide. Levels may vary widely and are usually in the range from about 0.1% to about 70%, more typically from about 0.5% to about 30%, by weight of the ADD compositions herein.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka While not preferred for ADD compositions of the present invention which comprise detersive enzymes, the present invention compositions may also comprise as the bleaching agent a chlorine-type bleaching material. Such agents are well known in the art, and include for example sodium dichloroisocyanurate ("NaDCC").

While effective ADD compositions herein may comprise only the nonionic surfactant system and builder, fully-formulated ADD compositions typically will also comprise other automatic dishwashing detergent adjunct materials to improve or modify performance. These materials are selected as appropriate for the properties required of an automatic dishwashing composition. For example, low spotting and filming is desired—preferred compositions have spotting and filming grades of 3 or less, preferably less than 2, and most preferably less than 1, as measured by the standard test of The American Society for Testing and Materials ("ASTM") D3556-85 (Reapproved 1989) "Standard Test Method for Deposition on Glassware During Mechanical Dishwashing".

Adjunct Materials

Detersive ingredients or adjuncts optionally included in the instant compositions can include one or more materials for assisting or enhancing cleaning performance, treatment of the substrate to be cleaned, or designed to improve the aesthetics of the compositions. They are further selected based on the form of the composition, i.e., whether the composition is to be sold as a liquid, paste (semi-solid), or solid form (including tablets and the preferred granular forms for the present compositions). Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as non-phosphate builders, chelants, enzymes, suds suppressors, dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, perfumes, solubilizing agents, carriers, processing aids, pigments, pH control agents, and, for liquid formulations, solvents, as described in detail hereinafter.

1. Detersive Enzymes

"Detersive enzyme", as used herein, means any enzyme having a cleaning, stain removing or otherwise beneficial effect in an ADD composition. Preferred detersive enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

In general, as noted, preferred ADD compositions herein comprise one or more detersive enzymes. If only one enzyme is used, it is preferably an amyolytic enzyme when the composition is for automatic dishwashing use. Highly preferred for automatic dishwashing is a mixture of proteolytic enzymes and amyloytic enzymes. More generally, the enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fungal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics, dishware and the like. Since enzymes are catalytic materials, such amounts may be very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.001% to about 6%, preferably 0.01%–1% by weight of a commercial enzyme preparation. Protease enzymes are usually present in such commercial preparations at levels sufficient to provide from 0.005 to 0.1 Anson units (AU) of activity per gram of composition. For automatic dishwashing purposes, it may be desirable to increase the active enzyme content of the commercial preparations, in order to minimize the total amount of non-catalytically active materials delivered and thereby improve spotting/filming results.

Suitable examples of proteases are the subtilisins which are obtained from particular strains of *B. subtilis* and *B. lichzeniformis*. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of Bacillus amyloliquefaciens subtilisin, as described in WO 95/10615 published Apr. 20, 1995 by Genencor International.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Amylases suitable herein include, for example, α-amylases described in British Patent Specification No. 1,296,839 (Novo), RAPIDASE®, International Bio-Synthetics, Inc. and TERMAMYL®, Novo Industries.

Engineering of enzymes (e.g., stability-enhanced amylase) for improved stability, e.g., oxidative stability is known. See, for example J. Biological Chem., Vol. 260, No. Jun. 11, 1985, pp 6518–6521. "Reference amylase" refers to a conventional amylase inside the scope of the amylase component of this invention. Further, stability-enhanced amylases, also within the invention, are typically compared to these "reference amylases".

The present invention, in certain preferred embodiments, can makes use of amylases having improved stability in detergents, especially improved oxidative stability. A convenient absolute stability reference-point against which amylases used in these preferred embodiments of the instant invention represent a measurable improvement is the stability of TERMAMYL® in commercial use in 1993 and available from Novo Nordisk A/S. This TERMAMYL® amylase is a "reference amylase", and is itself well-suited for use in the ADD (Automatic Dishwashing Detergent) compositions of the invention. Even more preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which preferred amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the preferred embodiments of the invention can be obtained from Novo Nordisk A/S, or from Genencor International.

Preferred amylases herein have the commonality of being derived using site-directed mutagenesis from one or more of the Baccillus amylases, especially the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. lichenizformis* alpha-amylase, known as TERMAMYL®, or the homologous position variation of a similar parent amylase, such as *B. amyloliquefaciens, B. subtilis*, or *B. stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE® and SUNLIGHT®;

(c) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

Cellulases usable in, but not preferred, for the present invention include both bacterial or fungal cellulases. Typically, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME® (Novo) is especially useful.

Suitable lipase enzymes for detergent use include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*. The LIPOLASE® enzyme derived from *Humicola lanuginosa* and commercially available from Novo (see also EPO 341,947) is a preferred lipase for use herein. Another preferred lipase enzyme is the D96L variant of the native Humicola lanuginosa lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

2. Enzyme Stabilizing System

The enzyme-containing compositions, especially liquid compositions, herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

The stabilizing system of the ADDs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is relatively large; accordingly, enzyme stability in-use can be problematic.

Suitable chlorine scavenger anions are widely known and readily available, and are illustrated by salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartate, salicylate, etc., and mixtures thereof can be used if desired. In general, since the chlorine scavenger function can be performed by several of the ingredients separately listed under better recognized functions, (e.g., other components of the invention such as sodium perborate), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other ingredients, if used. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

3. Optional Bleach Adjuncts (a) Bleach Activators

Preferably, the peroxygen bleach component in the composition is formulated with an activator (peracid precursor). The activator is present at levels of from about 0.01% to about 15%, preferably from about 0.5% to about 10%, more preferably from about 1% to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoyl-caprolactam, benzoyloxybenzenesulphonate (BOBS), nonanoyloxybenzene-sulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred bleach activators are those described in U.S. Pat. No. 5,130,045, Mitchell et al, and 4,412,934, Chung et al, and copending patent applications U.S. Ser. Nos. 08/064,624, 08/064,623, 08/064,621, 08/064,562, 08/064,564, 08/082,270 and copending application to M. Burns, A. D. Willey, R. T. Hartshorn, C. K. Ghosh, entitled "Bleaching Compounds Comprising Peroxyacid Activators Used With Enzymes" and having U.S. Ser. No. 08/133,691 (P&G Case 4890R), all of which are incorporated herein by reference.

The mole ratio of peroxygen bleaching compound (as AvO) to bleach activator in the present invention generally ranges from at least 1:1, preferably from about 20:1 to about 1: 1, more preferably from about 10:1 to about 3:1.

Quaternary substituted bleach activators may also be included. The present detergent compositions preferably comprise a quaternary substituted bleach activator (QSBA) or a quaternary substituted peracid (QSP); more preferably, the former. Preferred QSBA structures are further described in copending U.S. Ser. No. 08/298,903, 08/298,650, 08/298,906 and 08/298,904 filed Aug. 31, 1994, incorporated herein by reference.

(b) Organic Peroxides, especially Diacyl Peroxides

These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

(c) Metal-containing Bleach Catalysts

The present invention compositions and methods utilize metal-containing bleach catalysts that are effective for use in ADD compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of theses catalysts include $Mn^{IV}{}_2(u\text{-}O)_3$(1,4,7-trimethyl-1,4,7-triazacyclononane)$_2$-$(PF_6)_2$ ("MnTACN"), $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$(1,4,7-trimethyl-1,4,7-triazacyclononane)$_2$-$(ClO_4)_3$, and mixtures thereof. See also European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

The bleach catalysts useful in automatic dishwashing compositions and concentrated powder detergent compositions may also be selected as appropriate for the present invention. For examples of suitable bleach catalysts see U.S. Pat. No. 4,246,612 and U.S. Pat. No. 5,227,084.

See also U.S. Pat. No. 5,194,416 which teaches mononuclear manganese (IV) complexes such as Mn(1,4,7-trimethyl-1,4,7-triazacyclononane$(OCH_3)_3$-$(PF_6)$.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C-OH groups. Preferred ligands include sorbitol, iditol, dulsitol, mannitol, xylitol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

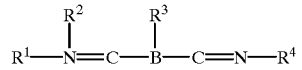

wherein $R^1$, $R^2$, $R^3$, and $R^4$ can each be selected from H, substituted alkyl and aryl groups such that each $R^1$—N=C—$R^2$ and $R^3$—C=N—$R^4$ form a five or six-membered ring. Said ring can further be substituted. B is a bridging group selected from O, S. $CR^5R^6$, $NR^7$ and C=O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and- bispyridylamine complexes. Highly preferred catalysts include Co(2,2'-bispyridylarnine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

The bleach catalysts may also be prepared by combining a water-soluble ligand with a water-soluble manganese salt in aqueous media and concentrating the resulting mixture by evaporation. Any convenient water-soluble salt of manganese can be used herein. Manganese (II), (III), (IV) and/or (V) is readily available on a commercial scale. In some instances, sufficient manganese may be present in the wash liquor, but, in general, it is preferred to detergent composition Mn cations in the compositions to ensure its presence in catalytically-effective amounts. Thus, the sodium salt of the ligand and a member selected from the group consisting of $MnSO_4$, $Mn(ClO_4)_2$ or $MnCl_2$ (least preferred) are dissolved in water at molar ratios of ligand:Mn salt in the range of about 1:4 to 4:1 at neutral or slightly alkaline pH. The water may first be de-oxygenated by boiling and cooled by spraying with nitrogen. The resulting solution is evaporated (under $N_2$, if desired) and the resulting solids are used in the bleaching and detergent compositions herein without further purification.

In an alternate mode, the water-soluble manganese source, such as $MnSO_4$, is added to the bleach/cleaning composition or to the aqueous bleaching/cleaning bath which comprises the ligand. Some type of complex is apparently formed in situ, and improved bleach performance is secured. In such an in situ process, it is convenient to use a considerable molar excess of the ligand over the manganese, and mole ratios of ligand:Mn typically are 3:1 to 15:1. The additional ligand also serves to scavenge vagrant metal ions such as iron and copper, thereby protecting the bleach from decomposition. One possible such system is described in European patent application, publication no. 549,271.

While the structures of the bleach-catalyzing manganese complexes useful in the present invention have not been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mn-ligand species which actually exists, it functions in an apparently catalytic manner to provide improved bleaching performances on stubborn stains such as tea, ketchup, coffee, wine, juice, and the like.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt (III) catalysts having the formula:

$$Co[(NH_3)_nM'_mB'_bT'_tQ_qP_p]Y_y$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof [optionally, Y can be protonated if more than one anionic group exists in Y, e.g., $HPO_4^{2-}$, $HCO_3^-$, $H_2PO_4^-$, etc., and further, Y may be selected from the group consisting of non-traditional inorganic anions such as anionic surfactants, e.g., linear alkylbenzene sulfonates (LAS), alkyl sulfates (AS), alkylethoxysulfonates (AES), etc., and/or anionic polymers, e.g., polyacrylates, polymethacrylates, etc.]; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred cobalt catalysts of this type have the formula:

$$[Co(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]Y_y$, and especially $[Co(NH_3)_5Cl]Cl_2$.

More preferred are the present invention compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof. Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, $F^-$, $SO_4^{-2}$, $NCS^-$, $SCN^-$, $S_2O_3^{-2}$, $NH_3$, $PO_4^{3-}$, and carboxylates (which preferably are mono-carboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, $HOC(O)CH_2C(O)O$—, etc.) Preferred M moieties are substituted and unsubstituted $C_1$–$C_{30}$ carboxylic acids having the formulas:

$$RC(O)O—$$

wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4{}^+$, —C(O)OR', —OR', —$C(O)NR'_2$, wherein R' is selected from the group consisting of hydrogen and $C_1$–$C_6$ moieties. Such substituted R therefore include the moieties —$(CH_2)_nOH$ and —$(CH_2)_nNR'_4{}^+$, wherein n is an integer from 1 to about 16, preferably from about 2 to about 10, and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.*, (1983), 2, pages 1–94. For example, Table 1 at page 17, provides the base hydrolysis rates (designated therein as $k_{OH}$) for cobalt pentaamine catalysts complexed with oxalate ($k_{OH}$=2.5×$10^{-4}$ $M^{-1}$ $s^{-1}$ (25° C.)), $NCS^-$ ($k_{OH}$=5.0×$10^{-4}$ $M^{-1}$ $s^{-1}$ (25° C.)), formate ($k_{OH}$=5.8×$10^{-4}$ $M^{-1}$ $s^{-1}$ (25° C.)), and acetate ($k_{OH}$=9.6×$10^{-4}$ $M^{-1}$ $s^{-1}$ (25° C.)). The most preferred cobalt catalyst useful herein are cobalt pentaamine acetate salts having the formula $[Co(NH_3)_5OAc]\ T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co\ (NH_3)_5OAc](BF_4)_2$; and $[Co(NH_3)_5OAc](NO_3)_2$.

These cobalt catalysts are readily prepared by known procedures, such as taught for example in the Tobe article hereinbefore and the references cited therein, in U.S. Pat. No. 4,810,410, to Diakun et al, issued Mar. 7, 1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.* 18, 1497–1502 (1979); *Inorg. Chem.,* 21, 2881–2885 (1982); *Inorg. Chem.*, 2023–2025 (1979); Inorg. Synthesis, 173–176 (1960); and *Journal of Physical Chemistry,* 56, 22–25 (1952).

These catalysts may be coprocessed with adjunct materials so as to reduce the color impact if desired for the aesthetics of the product, or to be included in enzyme-containing particles as exemplified hereinafter, or the compositions may be manufactured to contain catalyst "speckles".

As a practical matter, and not by way of limitation, the cleaning compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic dishwashing process, typical automatic dishwashing compositions herein will comprise from about 0.0005% to about 0.2%, more preferably from about 0.004% to about 0.08%, of bleach catalyst by weight of the cleaning compositions.

4. pH and Buffering Variation

Many detergent compositions herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

The preferred ADD compositions herein comprise a pH-adjusting component selected from water-soluble alkaline inorganic salts and water-soluble organic or inorganic builders. The pH-adjusting components are selected so that when the ADD is dissolved in water at a concentration of 1,000–10,000 ppm, the pH remains in the range of above about 8, preferably from about 9.5 to about 11. The preferred nonphosphate pH-adjusting component of the invention is selected from the group consisting of:

(i) sodium carbonate or sesquicarbonate;

(ii) sodium silicate, preferably hydrous sodium silicate having $SiO_2$:$Na_2O$ ratio of from about 1:1 to about 2:1, and mixtures thereof with limited quantities of sodium metasilicate;

(iii) sodium citrate;

(iv) citric acid;

(v) sodium bicarbonate;

(vi) sodium borate, preferably borax;

(vii) sodium hydroxide; and (viii) mixtures of (i)–(vii).

Preferred embodiments contain low levels of silicate (i.e. from about 3% to about 10% $SiO_2$).

Illustrative of highly preferred pH-adjusting component systems are binary mixtures of granular sodium citrate with anhydrous sodium carbonate, and three-component mixtures of granular sodium citrate trihydrate, citric acid monohydrate and anhydrous sodium carbonate.

The amount of the pH adjusting component in the instant ADD compositions is preferably from about 1% to about 50%, by weight of the composition. In a preferred embodiment, the pH-adjusting component is present in the ADD composition in an amount from about 5% to about 40%, preferably from about 10% to about 30%, by weight.

For compositions herein having a pH between about 9.5 and about 11 of the initial wash solution, particularly preferred ADD embodiments comprise, by weight of ADD, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

The essential pH-adjusting system can be complemented (i.e. for improved sequestration in hard water) by other optional detergency builder salts selected from nonphosphate detergency builders known in the art, which include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid; nitrilotriacetic acid, tartrate monosuccinic acid, tartrate disuccinic acid, oxydisuccinic acid, carboxymethoxysuccinic acid, mellitic acid, and sodium benzene polycarboxylate salts.

(a) Water-Soluble Silicates

The present automatic dishwashing detergent compositions may further comprise water-soluble silicates. Water-soluble silicates herein are any silicates which are soluble to the extent that they do not adversely affect spotting/filming characteristics of the ADD composition.

Examples of silicates are sodium metasilicate and, more generally, the alkali metal silicates, particularly those having a $SiO_2$:$Na_2O$ ratio in the range 1.6:1 to 3.2:1; and layered silicates, such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, Na SKS-6 and other water-soluble silicates useful herein do not contain aluminum. NaSKS-6 is the $\delta$-$Na_2SiO_5$ form of layered silicate and can be prepared by methods such as those described in German DE-A-3,417,649 and DE-A-3,742,043. SKS-6 is a preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used. Various other layered silicates from Hoechst include NaSKS-5, NaSKS-7 and NaSKS-11, as the $\alpha$-, $\beta$- and $\gamma$- forms. Other silicates may also be useful, such as for example magnesium silicate, which can serve as a crispening agent in granular formulations, as a stabilizing agent for oxygen bleaches, and as a component of suds control systems.

Silicates particularly useful in automatic dishwashing (ADD) applications include granular hydrous 2-ratio silicates such as BRITESIL® H20 from PQ Corp., and the commonly sourced BRITESIL®) H24 though liquid grades of various silicates can be used when the ADD composition has liquid form. Within safe limits, sodium metasilicate or sodium hydroxide alone or in combination with other silicates may be used in an ADD context to boost wash pH to a desired level.

6. Chelating Agents

The compositions herein may also optionally contain one or more transition-metal selective sequestrants, "chelants" or "chelating agents", e.g., iron and/or copper and/or manganese chelating agents. Chelating agents suitable for use herein can be selected from the group consisting of aminocarboxylates, phosphonates (especially the aminophosphonates), polyfunctionally-substituted aromatic chelating agents, and mixtures thereof. Without intending to be bound by theory, it is believed that the benefit of these materials is due in part to their exceptional ability to control iron, copper and manganese in washing solutions which are known to decompose hydrogen peroxide and/or bleach activators; other benefits include inorganic film prevention or scale inhibition. Commercial chelating agents for use herein include the DEQUEST® series, and chelants from Monsanto, DuPont, and Nalco, Inc.

Aminocarboxylates useful as optional chelating agents are further illustrated by ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts thereof. In general, chelant mixtures may be used for a combination of functions, such as multiple transition-metal control, long-term product stabilization, and/or control of precipitated transition metal oxides and/or hydroxides.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A highly preferred biodegradable chelator for use herein is ethylenediamine disuccinate ("EDDS"), especially (but not limited to) the [S,S] isomer as described in U.S. Pat. No. 4,704,233, Nov. 3, 1987, to Hartman and Perkins. The trisodium salt is preferred though other forms, such as magnesium salts, may also be useful.

Aminophosphonates are also suitable for use as chelating agents in the compositions of the invention when at least low levels of total phosphorus are acceptable in detergent compositions, and include the ethylenediaminetetrakis (methylenephosphonates) and the diethylenetriaminepentakis (methylene phosphonates). Preferably, these aminophosphonates do not contain alkyl or alkenyl groups with more than about 6 carbon atoms.

If utilized, chelating agents or transition-metal-selective sequestrants will preferably comprise from about 0.001% to about 10%, more preferably from about 0.05% to about 1% by weight of the compositions herein.

7. Dispersant Polymer

Preferred ADD compositions herein may additionally contain a dispersant polymer. When present, a dispersant polymer in the instant ADD compositions is typically at levels in the range from 0 to about 25%, preferably from about 0.5% to about 20%, more preferably from about 1% to about 8% by weight of the ADD composition. Dispersant polymers are useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are further illustrated by the film-forming polymers described in U.S. Pat. No. 4,379,080 (Murphy), issued Apr. 5, 1983.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1,000 to about 500,000, more preferably is from about 1,000 to about 250,000, and most preferably, especially if the ADD is for use in North American automatic dishwashing appliances, is from about 1,000 to about 5,000.

Other suitable dispersant polymers include those disclosed in U.S. Pat. No. 3,308,067 issued Mar. 7, 1967, to Diehl. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[(C($R^2$)C($R^1$)(C(O)O$R^3$)] wherein the apparently unfilled valencies are in fact occupied by hydrogen and at least one of the substituents $R^1$, $R^2$, or $R^3$, preferably $R^1$ or $R^2$, is a 1 to 4 carbon alkyl or hydroxyalkyl group; $R^1$ or $R^2$ can be a hydrogen and $R^3$ can be a hydrogen or alkali metal salt. Most preferred is a substituted acrylic monomer wherein $R^1$ is methyl, $R^2$ is hydrogen, and $R^3$ is sodium.

Suitable low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of about 3,500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535.

Agglomerated forms of the present ADD compositions may employ aqueous solutions of polymer dispersants as liquid binders for making the agglomerate (particularly when the composition consists of a mixture of sodium citrate and sodium carbonate). Especially preferred are polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula: $HO(CH_2CH_2O)_m(CH_2CH(CH_3)O)_n(CH(CH_3)CH_2O)_oOH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDonald, issued Feb. 27, 1979. Preferred cellulose-derived dispersant polymers are the carboxymethyl celluloses.

Yet another group of acceptable dispersants are the organic dispersant polymers, such as polyaspartate.

8. Material Care Agents

The present ADD compositions may contain one or more material care agents which are effective as corrosion inhibitors and/or anti-tarnish aids. Such materials are preferred components of machine dishwashing compositions especially in certain European countries where the use of electroplated nickel silver and sterling silver is still comparatively common in domestic flatware, or when aluminium protection is a concern and the composition is low in silicate. Generally, such material care agents include metasilicate, silicate, bismuth salts, manganese salts, paraffin, triazoles, pyrazoles, thiols, mercaptans, aluminium fatty acid salts, and mixtures thereof.

When present, such protecting materials are preferably incorporated at low levels, e.g., from about 0.01% to about 5% of the ADD composition. Suitable corrosion inhibitors include paraffin oil, typically a predominantly branched aliphatic hydrocarbon having a number of carbon atoms in the range of from about 20 to about 50; preferred paraffin oil is selected from predominantly branched $C_{25-45}$ species with a ratio of cyclic to noncyclic hydrocarbons of about 32:68. A paraffin oil meeting those characteristics is sold by Wintershall, Salzbergen, Germany, under the trade name WINOG 70. Additionally, the addition of low levels of bismuth nitrate (i.e., $Bi(NO_3)_3$) is also preferred.

Other corrosion inhibitor compounds include benzotriazole and comparable compounds; mercaptans or thiols including thionaphtol and thioanthranol; and finely divided Aluminium fatty acid salts, such as aluminium tristearate. The formulator will recognize that such materials will generally be used judiciously and in limited quantities so as to avoid any tendency to produce spots or films on glassware or to compromise the bleaching action of the compositions. For this reason, mercaptan anti-tarnishes which are quite strongly bleach-reactive and common fatty carboxylic acids which precipitate with calcium in particular are preferably avoided.

9. Silicone and Phosphate Ester Suds Suppressors

The ADD's of the invention can optionally contain an alkyl phosphate ester suds suppressor, a silicone suds suppressor, or combinations thereof. Levels in general are from 0% to about 10%, preferably, from about 0.001% to about 5%. However, generally (for cost and/or deposition considerations) preferred compositions herein do not comprise suds suppressors or comprise suds suppressors only at low levels, e.g., less than about 0.1% of active suds suppressing agent.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an ADD for use at 6000 ppm comprising 1% Tergitol 15S9 and 1 % SLF 18 may not require the presence of a suds suppressor.

If it is desired to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

10. Other Optional Adjuncts

Depending on whether a greater or lesser degree of compactness is required, filler materials can also be present in the instant ADDs. These include sucrose, sucrose esters, sodium sulfate, potassium sulfate, etc., in amounts up to about 70%, preferably from 0% to about 40% of the ADD composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates or EDDS in magnesium-salt form. Note that preferences, in terms of purity sufficient to avoid decomposing bleach, applies also to pH-adjusting component ingredients, specifically including any silicates used herein.

Although optionally present in the instant compositions, the present invention encompasses embodiments which are substantially free from sodium chloride or potassium chloride.

Hydrotrope materials such as sodium benzene sulfonate, sodium toluene sulfonate, sodium cumene sulfonate, etc., can be present, e.g., for better dispersing surfactant.

Bleach-stable perfumes (stable as to odor); and bleach-stable dyes such as those disclosed in U.S. Pat. No. 4,714,562, Roselle et al, issued Dec. 22, 1987 can also be added to the present compositions in appropriate amounts. Other common detergent ingredients consistent with the spirit and scope of the present invention are not excluded.

Since ADD compositions herein can contain water-sensitive ingredients or ingredients which can co-react when brought together in an aqueous environment, it is desirable to keep the free moisture content of the ADDs at a minimum, e.g., 7% or less, preferably 4% or less of the ADD; and to provide packaging which is substantially impermeable to water and carbon dioxide. Coating measures have been described herein to illustrate a way to protect the ingredients from each other and from air and moisture. Plastic bottles, including refillable or recyclable types, as well as conventional barrier cartons or boxes are another helpful means of assuring maximum shelf-storage stability. As noted, when ingredients are not highly compatible, it may further be desirable to coat at least one such ingredient with a low-foaming nonionic surfactant for protection. There are numerous waxy materials which can readily be used to form suitable coated particles of any such otherwise incompatible components; however, the formulator prefers those materials which do not have a marked tendency to deposit or form films on dishes including those of plastic construction.

Some preferred substantially chlorine bleach-free granular automatic dishwashing compositions of the invention are as follows: a substantially chlorine-bleach free automatic dishwashing composition comprising amylase (e.g., TERMAMYL®) and/or a bleach stable amylase and a bleach system comprising a source of hydrogen peroxide selected from sodium perborate and sodium percarbonate and a cobalt catalyst as defined herein. There is also contemplated a substantially chlorine-bleach free automatic dishwashing composition comprising an oxidative stability-enhanced amylase and a bleach system comprising a source of hydrogen peroxide selected from sodium perborate and sodium percarbonate, a cobalt catalyst, and TAED or NOBS.

Method for Cleaning:

The present invention also encompasses a method for cleaning soiled tableware comprising contacting said tableware with an aqueous medium comprising a cobalt catalyst, preferably at a concentration of from about 2 ppm to about 10 ppm, as described herein before. Preferred aqueous medium have an initial pH in a wash solution of above about 8, more preferably from about 9.5 to about 12, most preferably from about 9.5 to about 10.5.

This invention also encompasses a method of washing tableware in a domestic automatic dishwashing appliance, comprising treating the soiled tableware in an automatic dishwasher with an aqueous alkaline bath comprising amylase and a cobalt catalyst.

The following nonlimiting examples further illustrate ADD compositions of the present invention.

EXAMPLE 1

| | Weight % | |
|---|---|---|
| Ingredients: | A | B |
| Sodium Tripolyphosphate (STPP) | 24.0 | 45 |
| Sodium carbonate | 20.0 | 13.5 |
| Hydrated 2.0r silicate | 15 | 13.5 |
| Poly-Tergent ® SLF 18B Nonionic surfactant[4] | 2.0 | 2.0 |
| Tergitol 15S9 Nonionic surfactant[5] | 1.0 | 1.0 |
| Polymer[1] | 4.0 | — |
| Protease (4% active) | 0.83 | 0.83 |
| Amylase (0.8% active) | 0.5 | 0.5 |
| Perborate monohydrate (15.5% Active AvO)[2] | 14.5 | 14.5 |
| Cobalt catalyst[3] | 0.008 | — |
| Dibenzoyl Peroxide (18% active) | 4.4 | 4.4 |
| Water, sodium sulfate and misc. | Balance | Balance |

[1]Terpolymer selected from either 60% acrylic acid/20% maleic acid/20% ethyl acrylate, or 70% acrylic acid/10% maleic acid/20% ethyl acrylate.
[2]The AvO level of the above formula is 2.2%.
[3]Pentaamineacetatocobalt(III) nitrate prepared as described hereinbefore; may be replaced by MnTACN.
[4]Epoxy-capped poly(oxyalkylated) alcohol of Example III of WO 94/22800 wherein 1,2-epoxydodecane is substituted for 1,2-epoxydecane.
[5]Ethoxylated secondary alcohol supplied by Union Carbide (cloud point = 60° C.).

The ADD's of the above dishwashing detergent composition examples are used to wash lipstick-stained plastic and ceramic, tea-stained cups, starch-soiled and spaghetti-soiled dishes, milk-soiled glasses, starch, cheese, egg or babyfood-soiled flatware, and tomato-stained plastic spatulas by loading the soiled dishes in a domestic automatic dishwashing appliance and washing using either cold fill, 60° C. peak, or uniformly 45–50° C. wash cycles with a product concentration of the exemplary compositions of from about 1,000 to about 8,000 ppm, with excellent results.

The following examples further illustrate phosphate built ADD compositions which contain a bleach/enzyme particle, but are not intended to be limiting thereof. All percentages noted are by weight of the finished compositions, other than the perborate (monohydrate) component, which is listed as AvO.

| | 2 | 3 |
|---|---|---|
| Catalyst[1] | 0.008 | 0.004 |
| Savinase ™ 12T | — | 1.1 |
| Protease D | 0.9 | — |
| Duramyl ™ | 1.5 | 0.75 |
| STPP | 31.0 | 30.0 |
| $Na_2CO_3$ | 20.0 | 30.5 |
| Polymer[2] | 4.0 | — |
| Perborate (AvO) | 2.2 | 0.7 |
| Dibenzoyl Peroxide | 0.2 | 0.15 |
| 2 R Silicate ($SiO_2$) | 8.0 | 3.5 |
| Paraffin | 0.5 | 0.5 |
| Benzotriazole | 0.3 | 0.15 |
| SLF 18 Nonionic surfactant[4] | 1.0 | 1.0 |
| Rhodasurf TMD 8.5 Nonionic surfactant[3] | 1.0 | 2.0 |
| Sodium Sulfate, Moisture | --------Balance-------- | |

[1]Pentaamineacetatocobalt (III) nitrate; may be replaced by MnTACN.
[2]Polyacrylate or Acusol 480N or polyacrylate/polymethacrylate copolymers.
[3]Tridecyl alcohol ethoxylate supplied by Rhone Poulenc (cloud point = 60° C.).
[4]Supplied by Olin Corporation (cloud point = 18° C.).

In Compositions of Examples 2 and 3, respectively, the catalyst and enzymes are introduced into the compositions as 200–2400 micron composite particles which are prepared by spray coating, fluidized bed granulation, marumarizing, prilling or flaking/grinding operations. If desired, the protease and amylase enzymes may be separately formed into their respective catalyst/enzyme composite particles, for reasons of stability, and these separate composites added to the compositions.

EXAMPLES 4–5

The following describes catalyst/enzyme particles (prepared by drum granulation) for use in the present invention compositions. For example 5, the catalyst is incorporated as part of the granule core, and for example 4 the catalyst is post added as a coating. The mean particle size is in the range from about 200 to 800 microns.

Catalyst/Enzyme Particles for Examples 4 and 5

| | 4 | 5 |
|---|---|---|
| Core | | |
| Cobalt Catalyst (PAC) | — | 0.3 |
| Amylase, commercial | 0.4 | 0.4 |
| Fibrous Cellulose | 2.0 | 2.0 |
| PVP | 1.0 | 1.0 |
| Sodium Sulphate | 93.3 | 93.3 |
| Coating | | |
| Titanium Dioxide | 2.0 | 2.0 |
| PEG | 1.0 | 1.0 |
| Cobalt Catalyst (PAC) | 0.3 | — |

Granular dishwashing detergents wherein Example 4 is a Compact product and Example 5 is a Regular/Fluffy product are as follows:

| | 4 | 5 |
|---|---|---|
| Composite Particle | 1.5 | 0.75 |
| Savinase ™ 12T | 2.2 | — |
| Protease D | — | 0.45 |
| STPP | 34.5 | 30.0 |
| $Na_2CO_3$ | 20.0 | 30.5 |
| Acusol 480N | 4.0 | — |
| Perborate(AvO) | 2.2 | 0.7 |
| Dibenzoyl Peroxide | 0.2 | 0.15 |
| 2 R Silicate($SiO_2$) | 8.0 | 3.5 |
| Paraffin | — | 0.5 |
| Benzotriazole | — | 0.15 |
| SLF 18 Nonionic surfactant | 2.0 | 2.0 |
| Tergitol 15S9 Nonionic surfactant | 1.0 | 2.0 |
| Sodium Sulphate, Moisture | ---to balance---- | |

Other compositions herein are as follows:

| | 6 | 7 | 8 |
|---|---|---|---|
| STPP | 34.4 | 34.4 | 34.4 |
| $Na_2CO_3$ | 20.0 | 30.0 | 30.5 |
| Polymer[3] | 4.0 | — | — |
| Perborate (AvO) | 2.2 | 1.0 | 0.7 |
| Catalyst[1] | 0.008 | 0.004 | 0.004 |
| Savinase ™ 6.0T | — | 2.0[2] | 2.0[2] |
| Protease D | 0.9 | — | — |
| Duramyl ™ | 1.5 | 0.75 | — |
| Termamyl ™ 6.0T | — | — | 1.0 |
| Dibenzoyl Peroxide (active) | 0.8 | 0.6 | 0.4 |
| 2 R Silicate ($SiO_2$) | 8.0 | 6.0 | 4.0 |
| SLF 18 Nonionic Surfactant | 2.0 | 1.5 | 1.2 |
| Renex 36[4] | 2.0 | 1.5 | 2.5 |
| Sodium Sulfate, Moisture | ----------Balance-------- | | |

[1]Pentaamineacetatocobalt (III) nitrate; may be replaced by MnTACN.
[2]May be replaced by 0.45 Protease D.
[3]Polyacrylate or Acusol 480N.
[4]$C_{11-14}$ Isoalcohol ethoxylate supplied by ICI (cloud point = 55° C.).

In Compositions of Examples 6–8, respectively, the catalyst and enzymes are introduced into the final compositions as 200–2400 micron catalyst/enzyme composite particles which are prepared by spray coating, marumarizing, prilling or flaking/grinding operations. If desired, the protease and amylase enzymes may be separately formed into their respective catalyst/enzyme composite particles, for reasons of stability, and these separate composites added to the compositions.

| | 9 | 10 | 11 |
|---|---|---|---|
| STPP | 31.0 | 31.0 | 31.0 |
| $Na_2CO_3$ | 20.0 | 20.0 | 20.0 |
| Polymer[3] | 4.0 | 4.0 | 4.0 |
| Perborate (AvO) | 2.2 | 2.2 | 2.2 |
| Catalyst[1] | 0.008 | — | 0.018 |
| Savinase ™ 6.0T[2] | 2.0 | 2.0 | 2.0 |
| Termamyl ™ 6.0T | 1.0 | 1.0 | 1.0 |
| TAED | 2.0 | — | 1.0 |
| Cationic Activator[4] | — | 2.0 | — |
| 2 R Silicate ($SiO_2$) | 8.0 | 8.0 | 8.0 |
| Metasilicate | — | — | 2.5 |
| SLF 18 Nonionic surf. | 0.5 | 1.0 | 1.5 |

-continued

| | 9 | 10 | 11 |
|---|---|---|---|
| Tergitol 15S9 Nonionic surf. | 1.0 | 1.0 | 0.75 |
| Sodium Sulfate, Moisture | ----------Balance--------- | | |

[1]Pentaamineacetatocobalt (III) nitrate; may be replaced by MnTACN.
[2]May be replaced by 0.45 Protease D.
[3]Polyacrylate or Acusol 480N.
[4]6-Trimethylammoniocaproyl caprolactam, tosylate salt.

Any of the foregoing ADD compositions can be used in the conventional manner in an automatic dishwashing machine to cleanse dishware, glassware, cooking/eating utensils, and the like.

EXAMPLE 12

| Component | % |
|---|---|
| Sodium carbonate | 30.50 |
| Sodium phosphate | 30.00 |
| 2 R Silicate($SiO_2$) | 7.30 |
| TAED | 1.000 |
| PB1 (as AvO) | 0.66 |
| Benzotriazole | 0.15 |
| Savinase 12T | 1.10 |
| Termamyl 120T | 0.38 |
| Paraffin | 0.25 |
| Sulfate | 27.90 |
| SLF 18 Nonionic surfactant | 1.0 |
| Tergitol 15S9 Nonionic surfactant | 1.0 |

| Component | % |
|---|---|
| Sodium carbonate | 14.00 |
| Sodium phosphate | 54.40 |
| Sodium silicate ($SiO_2$) | 14.80 |
| Co Catalyst[1)] | 0.004 |
| PB1 (as AvO) | 1.20 |
| Savinase 12T | 2.20 |
| Termamyl 120T | 0.75 |
| Winog | 0.50 |
| Sulfate | 10.34 |
| SLF 18 Nonionic surfactant | 1.00 |
| Tergitol 15S9 Nonionic surfactant | 1.00 |

[1)]Pentaamineacetatocobalt (III) nitrate; may be replaced by MnTACN.

EXAMPLE 14

The following detergent composition tablets in accord with the present invention of 25 g weight are prepared by compression of a granular dishwashing detergent composition at a pressure of 13KN/$cm^2$ using a standard 12 head rotary press:

| | A | B | C |
|---|---|---|---|
| STPP | — | 48.80 | 47.50 |
| Citrate | 26.40 | — | — |
| Sodium Carbonate (anhydrous) | — | 5.00 | — |
| Na Silicate (amorphous; $SiO_2$:$Na_2O$ = 2) | 26.40 | 14.80 | 25.00 |
| Protease | 1.76 | 2.20 | 0.60 |
| Amylase | 1.20 | — | 0.60 |
| Na Perborate monohydrate | 1.56 | 7.79 | — |
| Na Perborate tetrahydrate | 6.92 | — | 11.40 |

-continued

| | A | B | C |
|---|---|---|---|
| SLF 18 Nonionic surfactant | 1.00 | 2.00 | 1.00 |
| Tergitol 15S9 Nonionic surfactant | 1.00 | 1.00 | 2.00 |
| TAED | 4.33 | 2.39 | 0.80 |
| HEDP[1] | 0.67 | — | — |
| DETPMP[2] | 0.65 | — | — |
| Paraffin | 0.42 | 0.50 | — |
| Benzotriazole | 0.24 | 0.30 | — |
| Polyacrylic acid (MW = 8000) | 3.2 | — | — |
| Sulphate | 25.05 | 14.70 | 3.20 |
| pH (1% solution) | 10.60 | 10.60 | 11.00 |

[1] Ethane 1-hydroxy-1,1-diphosphonic acid
[2] Diethyltriamine penta (methylene) phosphonate, marketed by Monsanto under the tradename Dequest 2060

EXAMPLE 15

A chlorine bleach-containing automatic dishwashing composition according to the present invention is prepared as follows.

| | Weight % |
|---|---|
| STPP | 30 |
| Sodium Carbonate | 23 |
| Silicate | 19 |
| SLF 18 Nonionic surfactant | 1 |
| Neodol 91-8 Nonionic surfactant[1] | 1 |
| NaDCC | 2 |
| Sulphate; Minors | Balance |

[1]Commercially available from Shell Chemical Corp. (cloud point = 80° C.)

What is claimed is:

1. An automatic dishwashing detergent composition comprising:

(a) from about 5% to about 90% by weight of the composition of a builder;

(b) from about 0.1% to about 15% by weight of the composition of a mixed nonionic surfactant system, wherein said mixed nonionic surfactant system comprises one or more low cloud point nonionic surfactants having a cloud point of less than 30° C. and one or more high cloud point nonionic surfactants having a cloud point of greater than 40° C., the ratio of low cloud point to high cloud point nonionic surfactants being within the range of from about 10:1 to about 1:10;

(c) optionally, from about 0.1% to about 40% by weight of the composition of a bleaching agent;

(d) adjunct materials; and wherein the mixed surfactant system dissolves in water having a hardness of 1.246 mmol/L under dishwashing conditions with a interfacial tension of less than 4 Dynes/cm at 45° C.

2. An automatic dishwashing detergent composition according to claim 1 comprising a) one or more low cloud point nonionic surfactants having a cloud point of less than 30° C.; and b) one or more high cloud point nonionic surfactants having a cloud point of greater than 40° C., wherein the high cloud point surfactant is present in a first matrix and the low cloud point surfactant is present in a second matrix.

3. The automatic dishwashing detergent composition according to claim 1 further comprising a detersive enzyme.

4. The automatic dishwashing detergent composition according to claim 1 comprising a metal-containing bleach catalyst selected from the group consisting of manganese-containing bleach catalysts, cobalt-containing bleach catalysts, and mixtures thereof.

5. The automatic dishwashing detergent composition according to claim 4 wherein said cobalt-containing bleach catalyst has the formula:

$$Co[(NH_3)_nM'_mB'_bT'_tQ_qP_p]Y_y$$

wherein cobalt is in the +3 oxidation state; n is an integer from 0 to 5; M' represents a monodentate ligand; m is an integer from 0 to 5; B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b+3t+4q+5p=6; Y is one or more appropriately selected counteranions present in a number y, where y is an integer from 1 to 3, to obtain a charge-balanced salt; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts versus a normal hydrogen electrode.

6. The automatic dishwashing detergent composition according to claim 4 wherein the bleach catalyst is selected from the group consisting of pentaamineacetatocobalt (III) nitrate, MnTACN, and mixtures thereof.

7. The automatic dishwashing detergent composition according to claim 1 wherein the composition comprises a chlorine bleaching agent.

8. The automatic dishwashing detergent composition according to claim 1 wherein the high cloud point nonionic surfactant further has a hydrophile-lipophile balance value within the range of from about 11 to about 15.

9. The automatic dishwashing detergent composition according to claim 1 wherein the low cloud point nonionic surfactants have a cloud point of less than about 20° C.

10. The automatic dishwashing detergent composition according to claim 1 comprising a phosphate builder.

11. The automatic dishwashing detergent composition according to claim 1 wherein the high cloud point nonionic surfactants have a cloud point of greater than about 50° C.

12. The automatic dishwashing detergent composition according to claim 1 wherein the high cloud point nonionic surfactants are selected from the group consisting of straight chain fatty alcohols containing from about 6 to about 20 carbon atoms, branched chain fatty alcohols containing from about 6 to about 20 carbon atoms, secondary fatty alcohols containing from about 6 to about 20 carbon atoms, branched alcohol ethoxylates condensed with an average of from about 6 to about 15 moles of ethylene oxide per mole of alcohol secondary alcohol ethoxylates condensed with an average of from about 6 to about 15 moles of ethylene oxide per mole of alcohol, and mixtures thereof.

13. The automatic dishwashing detergent composition according to claim 1 wherein the low cloud point nonionic surfactants are selected from the group consisting of ethoxylates derived from primary alcohol, polyoxypropylene/polyoxyethylenelpolyoxypropylene reverse block polymers, ethoxylated-propoxylated alcohol, epoxy-capped poly (oxyalkylated) alcohols, and mixtures thereof.

14. The automatic dishwashing detergent composition according to claim 1 comprising a bleaching agent selected from the group consisting of hydrogen peroxide, a source of hydrogen peroxide, and mixtures thereof.

15. The automatic dishwashing detergent composition according to claim 14 comprising a bleaching agent selected from the group consisting of sodium perborate, sodium percarbonate, and mixtures thereof.

16. The automatic dishwashing detergent composition according to claim 1 comprising an adjunct material selected from the group consisting of bleach activator material, detersive enzyme, suds suppressor, perfume, enzyme stabilizing system, material care agents, dispersant polymer, chelating agent, water-soluble silicates, pH-adjusting components, and mixtures thereof.

17. The automatic dishwashing detergent composition according to claim 1 in the form of granules, tablets, or liquidgels.

18. The automatic dishwashing detergent composition according to claim 1 comprising an enzyme selected from the group consisting of amylase, protease, lipase, cellulase and mixtures thereof.

19. An automatic dishwashing detergent composition comprising:

(a) from about 5% to about 90% by weight of the composition of a phosphate builder;

(b) from about 0. 1% to about 15% by weight of the composition of a mixed nonionic surfactant system, wherein said mixed nonionic surfactant system comprises one or more low cloud point nonionic surfactants having a cloud point of less than 30° C. and one or more high cloud point nonionic surfactants having a cloud point of greater than 40° C., the ratio of low cloud point to high cloud point nonionic surfactants being within the range of from about 10:1 to about 1:10;

(c) from about 0.1% to about 40% by weight of the composition of a bleaching agent;

(d) adjunct materials;

(e) from about 0.00001% to about 10% by weight of the composition of a detersive enzyme; and wherein the mixed surfactant system dissolves in water having a hardness of 1.246 mmol/L under dishwashing conditions with a interfacial tension of less than 4 Dynes/cm at 45° C.

20. A method of washing tableware in a domestic automatic dishwashing appliance, said method comprising treating the soiled tableware in an automatic dishwasher with an aqueous alkaline bath comprising an automatic dishwashing composition according to claim 1.

* * * * *